US008000075B2

(12) United States Patent
Brice et al.

(10) Patent No.: US 8,000,075 B2
(45) Date of Patent: Aug. 16, 2011

(54) TUBE INTEGRITY SAFETY SWITCH

(75) Inventors: Martin Brice, Charlotte, NC (US); Tharwat Saad, Huntersville, NC (US)

(73) Assignee: Gas-Fired Products, Inc., Charlotte, NC (US)

( * ) Notice: Subject to any disclaimer, the term of this patent is extended or adjusted under 35 U.S.C. 154(b) by 530 days.

(21) Appl. No.: 12/015,021

(22) Filed: Jan. 16, 2008

(65) Prior Publication Data

US 2009/0180232 A1 Jul. 16, 2009

(51) Int. Cl.
*H02H 5/04* (2006.01)

(52) U.S. Cl. ..... 361/103

(58) Field of Classification Search ..... 361/104; 126/91 A

See application file for complete search history.

(56) References Cited

U.S. PATENT DOCUMENTS

| | | | | |
|---|---|---|---|---|
| 2,006,810 | A * | 7/1935 | Kunz | 337/403 |
| 2,253,719 | A * | 8/1941 | McMahon | 337/279 |
| 2,432,145 | A * | 12/1947 | Evans | 136/214 |
| 3,950,746 | A * | 4/1976 | Davies | 340/521 |
| 7,654,257 | B2 * | 2/2010 | Vancak | 126/91 A |
| 2006/0258121 | A1 * | 11/2006 | Wu | 438/467 |
| 2009/0056929 | A1 * | 3/2009 | Mulder | 165/247 |

FOREIGN PATENT DOCUMENTS

JP 08030336 * 2/1996

* cited by examiner

*Primary Examiner* — Rexford Barnie
*Assistant Examiner* — Tien Mai
(74) *Attorney, Agent, or Firm* — Clements Bernard PLLC; Gregory N. Clements

(57) ABSTRACT

A safety device for disabling a positive pressure radiant tube heater upon failure of the heat exchanger and a corresponding method are described. This invention relates to the ability to detect a condition where a failure of the heat exchanger triggers the safety device and disables the heater. The safety device includes a low melt wire; an insulating sleeve positioned about the low melt wire, the wire and sleeve positioned on top of the reflector, a tension device to maintain the wire under tension; and a control device to disable the heater if the wire is discontinuous.

22 Claims, 3 Drawing Sheets

TUBE INTEGRITY SAFETY SWITCH

BACKGROUND OF THE INVENTION

1) Field of the Invention

A safety device for disabling a positive pressure radiant tube heater upon failure of the heat exchanger and a corresponding method are described. In accordance with the current revision of ANSI Z83.20 (the standard for low intensity radiant heaters), radiant tube heaters are mounted within an enclosed space such that the top, two sides and the bottom of the heaters are simultaneously arranged such that the maximum surface temperature on any combustible item, such as a wall, does not exceed 90 degrees above ambient, to determine the clearances to combustible materials distances. This invention relates to the ability to detect a condition where a failure of the heat exchanger (which may result in elevated temperatures within the clearance to combustible distance above the heater that can cause a potential fire hazard) triggers the safety device and disables the heater. The safety device includes a low melt wire, preferably an insulating sleeve positioned about the low melt wire, the wire and sleeve positioned on top of the reflector, a tension device to maintain the wire under tension, whereupon if the wire is or becomes discontinuous the heater will be disabled.

2) Prior Art

Radiant tube heaters are commonly known to comprise the following: a burner assembly incorporating a gas valve, ignition control, pressure switch, combustion air blower, burner head, a heat exchanger emitter tube functionally designed to enclose the flame and products of combustion during operation of the heater, a reflector to downwardly direct the heat from said heat exchanger, and a suspension system to support the weight of said burner assembly, heat exchanger tube, and reflector.

There are currently two distinct methods of combustion air inducement for radiant tube heaters. The pull system has a burner which is at the opposite end of an exhaust end, and the air for combustion is induced into the system under negative pressure. Generally, a blower is mounted on the exhaust end to create the negative pressure. In the push system, the air is supplied into the burner end of the tube heater under positive pressure and the heat exchanger is pressurized.

Principally radiant tube heaters are designed to operate at a plurality of different heat input rates, from about 25,000 Btu/hr up to about 300,000 Btu/hr, where the common adjustments for input rate include: adjustment of gas pressure, change of gas injector size, air metering plate, combustion air blower, and the total length of heat exchanger. Substantially, radiant tube heaters are designed with the intention of making the flame as long as possible for each input rate in order to spread the heat as far along the heat exchanger as possible. This design intention results in a different location of the highest temperature measured on the surface of the heat exchanger tube. This can vary between about 12 inches to about 96 inches along the length of the heat exchanger. The highest temperature location will vary for the same heat input depending on the length and configuration of the heat exchanger tubes.

A potential cause for increased temperature above the reflector, which would result in excessive temperatures within the distance specified as the clearance to combustible materials, is if the heat exchanger fails and the products of combustion are under positive pressure. Specifically, if the heat exchanger of the tube heater has a burn through, for example, then flames and products of combustion, under pressure, will exit the heat exchanger. Combustible material that was a safe distance away from the heat exchanger is now in jeopardy of burning. Moreover, the preferred material for the reflector is aluminum for its reflective properties. Under these conditions the reflector will melt allowing the flame to penetrate through the reflector.

For this reason the current state of the art is to use higher service temperature heat exchangers, typically Alumatherm® metal is a commonly used material in the manufacture of the heat exchanger tube. The premise is that with the higher service temperature materials, there usually is sufficient safety factor to prevent heat exchanger burn through, and reduce the risk of elevated temperatures within the clearance to combustible distance above the heater that can cause a potential fire hazard.

This invention is concerned with providing an extra safety device such that when an unforeseen tube failure has occurred, the heater will turn off safely.

Heat sensing devices exist as commercially available materials, such as heat sensitive wire, wire that will make contact due to high temperature, bimetallic switches, fusible links, and thermal fuses. Normally because the exact location of the heat exchanger failure is difficult to predict and it will vary depending on the heat input rate, these devices are expensive because they must be positioned every couple of inches from one another to insure a burn through of the heat exchanger is detected. Thus a need exists for a safety device that continuously covers a length of the heat exchanger where it is predicted a failure can occur, typically the first section of heat exchanger (usually within the first 10 feet).

SUMMARY OF THE INVENTION

The invention is a low melting point wire, under tension, preferably within an insulated sleeve to prevent electrical shorting on the reflector. The device for providing tension on the wire is preferably a spring (spring steel). A break in the electrical circuit occurs when the heat exchanger develops a hole and the products of combustion quickly melt the reflector and then the low melting point wire, whereupon if the wire is or becomes discontinuous the heater will be disabled.

In the broadest sense the invention is a safety device for disabling an electrically grounded positive pressure radiant tube heater upon failure of the heat exchanger, comprising a radiant tube heat exchanger, a reflector positioned above said heat exchanger, a low melt wire, an electrical insulator positioned between said low melt wire and any of said grounded components of the heater, a tension device to maintain said wire under tension, whereupon if the wire is or becomes discontinuous the heater will be disabled.

In the broadest sense, the present invention is a safety device for disabling a radiant tube heater upon failure of the heat exchanger, comprising a radiant heat exchanger, a reflector positioned above said heat exchanger, a low melt wire, an electrical insulator positioned between said low melt wire and said reflector, said wire and said insulator positioned on top of said reflector, a tension device to maintain said wire under tension, whereupon if the wire is discontinuous the heater will be disabled In the broadest sense, the present invention also includes a method for safely operating a positive pressure radiant tube heater incorporating a device intended to disable the heater in the event that there is a failure of the heat exchanger, comprising providing a low melt wire loop in the electrical circuit, insulating said wire from any grounded components of the heater, and positioning said wire above said heat exchanger.

In the broadest sense the present invention is a safety device for disabling a radiant tube heater upon failure of the heat exchanger, comprising a radiant tube heat exchanger, a reflector positioned above said heat exchanger, a low melt wire, a tension device to maintain said wire under tension and insulatively spaced from said reflector, whereupon if the wire is discontinuous the heater will be disabled.

BRIEF DESCRIPTION OF THE DRAWINGS

These and other features, aspects and advantages of the present invention are better understood when the following detailed description of the invention is read with reference to the accompanying drawings, in which.

Although these drawings illustrate the present invention, the scale between the figures in not consistent and therefore no spatial relationships between the figures is possible. Furthermore the drawings are meant to aid in the understanding of the invention and are not meant to further limit the scope of the claims beyond what is claimed.

DESCRIPTION OF THE INVENTION

Figure 1:
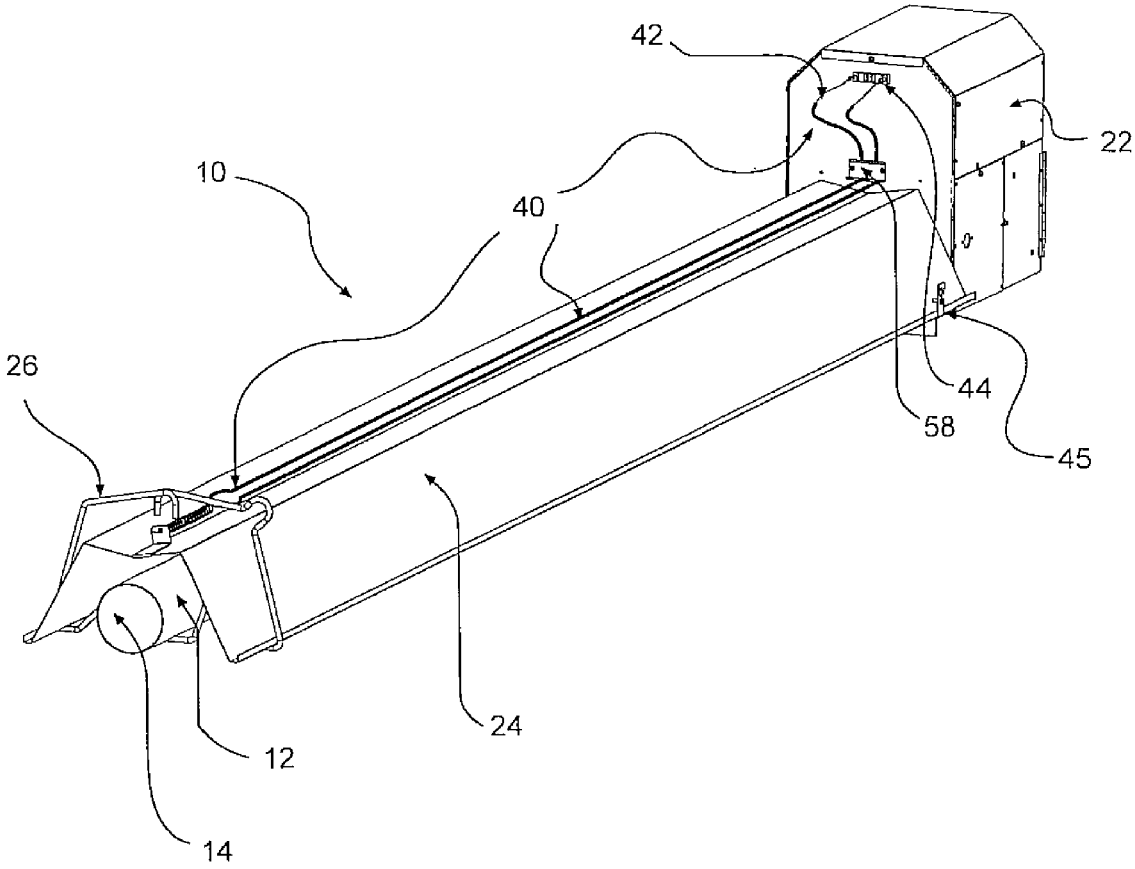
FIG. 1 is a perspective view of the positive pressure radiant tube heater.
Figure 4:
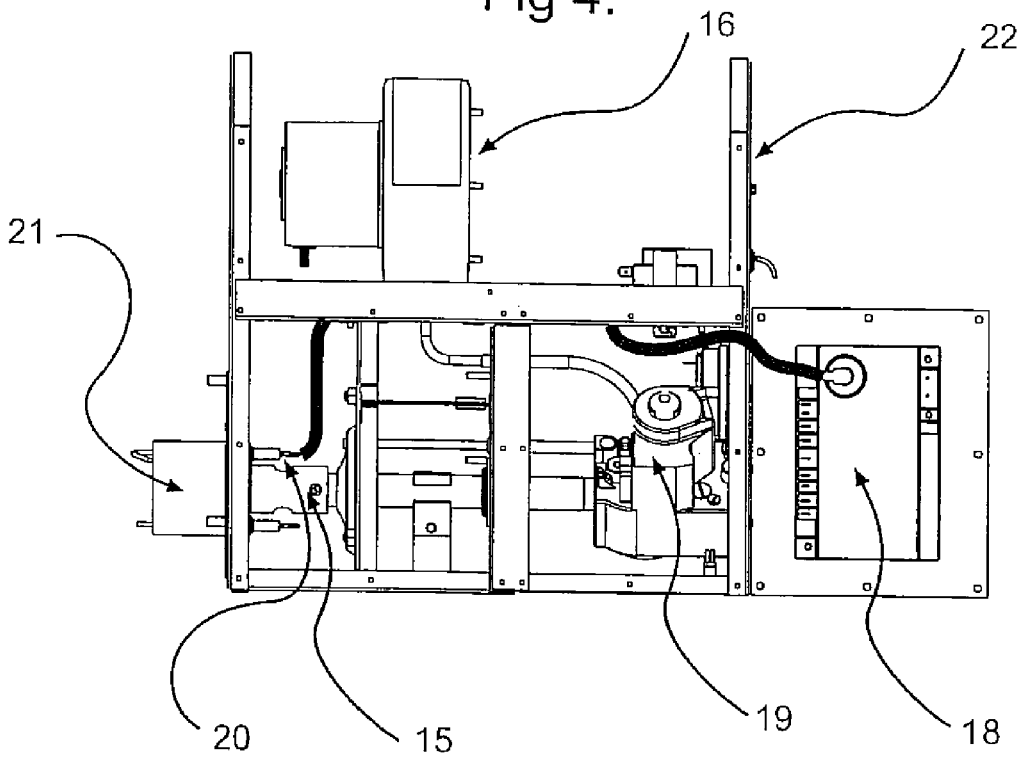
FIG. 4 is a side view of a typical burner assembly and internal components.
Figure 5:
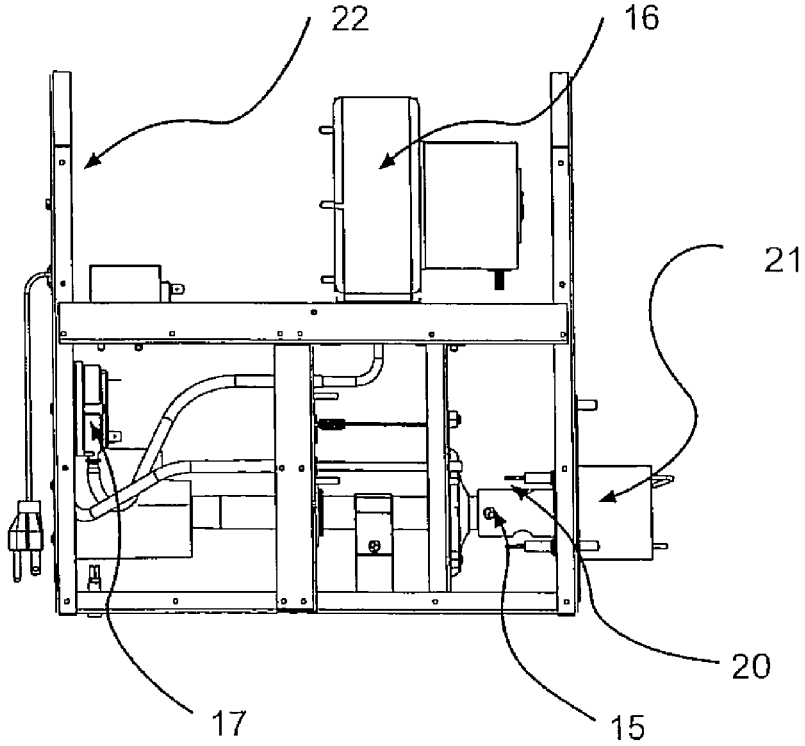
FIG. 5 is the opposite side view of the typical burner assembly and internal components.

Positive pressure radiant tube heaters are conventionally known in the industry. These devices are used for all types of industrial, commercial and agricultural purposes such as heating aircraft hangers, warehouses and poultry barns. It is not necessary in the use of the present invention to maintain a dirt free, dust free environment. Although the invention is designed for use with positive pressure radiant tube heaters, the present safety device could be used on negative pressure radiant tube heaters. Conventionally, as shown in FIG. 1, the positive pressure radiant heater 10 has one or more heat exchanger tubes 12, having an end 14 to exhaust the hot combusted gasses. At its intake end, the heat exchanger 12 has a burner assembly 22 as shown in FIGS. 4 and 5, incorporating a blower 16 for introducing air into the heat exchanger when it is activated by supplying power either manually by a switch or automatically by a thermostat. The flow induced by the blower is sensed by the pressure switch 17 and if sufficient flow is present then a control device 18 is activated to permit the flow of fuel gasses through the gas valve 19 to the injector 15 and into the burner head 21 where the gas mixes with the pressurized air to form a combustible mixture. The control device 18 simultaneously begins the ignition cycle with ignitor 20, enabling the combustible mixture to ignite and establish a flame within the heat exchanger tube. The blower 16 and the control device 18 are typically powered by electrical current. Thus, the burner assembly 22 encompasses items covered by reference numerals 15-21, inclusive.

The heater generally includes a reflector 24 that reflects the radiant heat downwardly since it is typically suspended below the ceiling of a building by a plurality of suspension hangers 26 shown in FIG. 1.

The heat exchanger tube must be made of a metal that can significantly withstand the heat as well as the continual thermal heating and cooling cycles, as the heater is turned on and off. Preferably the heat exchanger should be made of a material with a high emissivity to maximize the radiant heat output. Thus the heat exchanger tube may be made from ALUMATHERM® metal, which is steel coated with an aluminum alloy. This material may be heat treated to improve the emissive properties.

Under extreme conditions not associated with normal use, the heat exchanger tubes 12 may become brittle and form cracks, or even break open, almost always in the top portion of the tube, therefore not directly visible from any perspective below the heater. The positive pressure in the heat exchanger tube will then force the combustible gas out the cracks or opening. Due to the extreme heat (1400° F. is not uncommon), any aluminum items would melt, including the reflector 24. Should this happen, any combustible materials located at the tested safe distance away from the top of the heater will be exposed to higher temperatures and may result in a fire hazard. Up to this point, the description of the radiant heater and its operation is fairly typical.

Figure 2:
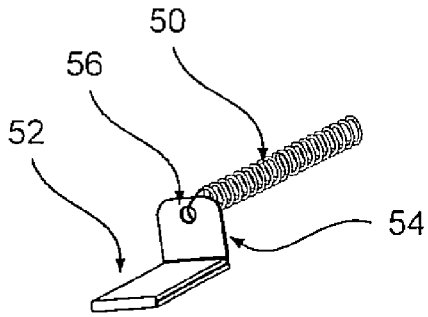
FIG. 2 is a perspective view of the clamp for holding the spring.
Figure 3:
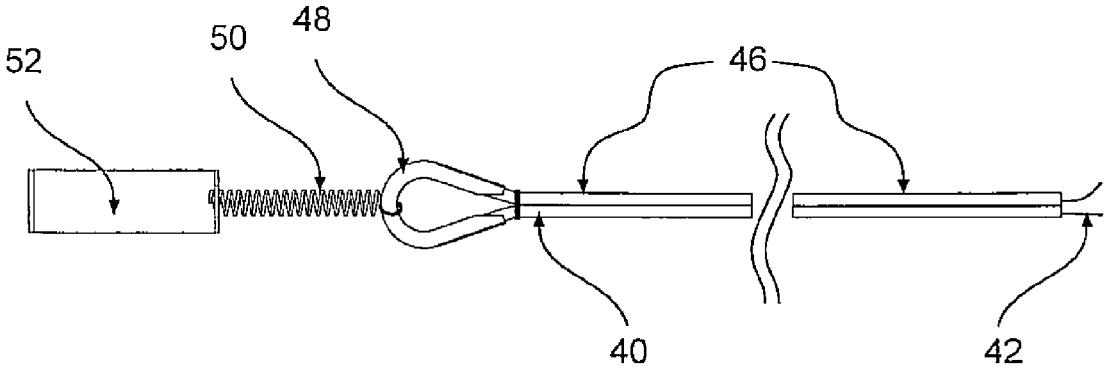
FIG. 3 is a plan view of clamp, spring and insulated sleeve carrying the low melt wire.

To prevent the possibility of this fire hazard, the present invention has a tube integrity safety system 40, as shown in FIGS. 1 and 2 and 3. The tube integrity safety system (TISS) includes a low melt wire loop, having two ends that plug into an outlet 44, to complete an electrical circuit, associated with the control device 18. The wire 42 runs in a loop along the outside top of the reflector 24 along the length of the heat exchanger where it is predicted that a failure can occur in the heater exchanger tube 12. After a variable distance depending on the heat input rate, the gas has generally been completely combusted, and only hot gas remains that no longer supports a flame. Accordingly it is generally not necessary to make the length of the low melt wire 42 longer than the first full section of the heat exchanger tube 12. The wire 42 is shown encased in a heat and electrically insulated sleeve 46. While a sleeve is preferred and therefore illustrated in the drawings, any electrical insulator will suffice and can take any form, such as a strip insulator made from the same material described later, and positioned such that the low melt wire does not ground out against any grounded component of the heater. Also the wire could be spaced away from the reflector, an insulating distance away such that it does not ground against the grounded heater, thereby eliminating the need for an insulator.

As shown in FIG. 1, the sleeve 46 with wire 42, run to the end of the first length of tube and loop around a thimble 48. The thimble 48 and the wire 42 are placed under light tension by spring 50. Spring 50 can be substituted by a hanging weight, a spring bow, or a spring clip or other component that can support the tension without extending beyond its elastic limit. One end of spring 50 attaches to the thimble 48, as shown in FIG. 3, while the other end of the spring attaches to a clip 52. The clip 52, shown in FIG. 2 has a small vertical portion 54 with a hole 56 therein. Clip 52 also has a piece that is folded back upon itself, and this allows the clip to slide on the end of the first section of the reflector 24, as shown in FIG. 1. It is anticipated that the clip could be replaced by a bracket (s) attached to the reflector, or by a bracket(s) attached to the heat exchanger, or any other combination of brackets that would maintain a wire in a tensile relationship between two fixed points on the heater. Thus the spring 50 pulls the thimble against the mounted clip, and the sleeve and wire are under slight tension. Near the other end of the looped wire 42 is a clamp 58, as shown in FIG. 1 that holds that end of the loop wire 42 stationary. Should the spring require additional tension, the clamp 58 can be loosened and the tension in spring 50 can be adjusted by pulling the wire through the clamp. If it is desired to maintain a longitudinal space between the reflector 24 and the burner assembly 22, then an attachment method such as a clamp(s) or screw(s) 45 can be employed to restrain the reflector from moving longitudinally towards the burner assembly 22 due to the tension of the spring 50.

The low melt wire 42 can be made of any practical material, but most preferably from a low melting point alloy, such as aluminum, tin, cadmium, bismuth, zinc, and compounds of these metals, and mixtures of these metals. Thus any low melt wire 42 (having a melt temperature in the range of these metals) is suitable.

If the tube becomes extremely brittle and cracks such that a hole develops, and the heater is operational during this time, the pressurized flames will pass through the hole. The reflector starts melting within a few seconds, and now the flame attacks the sleeve and low melt wire 42. The wire 42 melts and the spring pulls the wire apart so that it is no longer continuous and the heater is disabled, such as the control 18 has its electrical circuit disrupted and it closes off the flow of gas, either directly or indirectly. The heater can also be disabled by the circuit broken to any one or combination of the blower, pressure switch, gas valve, thermostat, main power supply, or ignition control. TISS prevents a potential fire hazard.

The sleeve 46 can be made from fiber glass, ceramic fibers, asbestos fibers, polyester fibers, mica paper, phlogopite, muscovite or a composition including any of these, or a combination of two or more of these. The sleeve can be a knitted, woven, or braided tube. Although a sleeve is shown and discussed, an insulator material 46 that prevents the low melt wire from grounding out on the reflector, for example, is satisfactory. Thus it is not necessary that the insulator be a sleeve as it could simply be a flat strip made from these same materials, and can simply be flat sheet like strips, that is positioned between the low melt wire and any grounded components of the heater.

The sleeve 46 is a heat insulator that keeps the low melt wire 42 from melting from the residual heat during normal operation of the heater. Sleeve 46 is also an electrical insulator to prevent the wire 42 from contacting any grounded components of the heater which include the metal reflector 24 and the burner assembly 22, once again completing the circuit, and turning on the heater once again. The spring pulls the melted wire apart to prevent the melted wire from cooling within the sleeve, and reforming its continuity. As stated above the sleeve 46 can be replaced with another insulator as described.

Thus it is apparent that there has been provided, in accordance with the invention, a safety device for a radiant heater and a method of operating a safety device during operation of a radiant heater that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A safety device for disabling an electrically grounded positive pressure radiant tube heater upon failure of the heat exchanger, comprising a radiant tube heat exchanger; a reflector positioned above said heat exchanger, a low melt wire positioned above and extending the length of said reflector, an electrical insulator positioned between said low melt wire and said reflector, a tension device to maintain said wire under tension, whereupon the heater will be disabled if the wire is discontinuous.

2. The safety device of claim 1, wherein said heat exchanger is in the shape of a tube, and the reflector extends substantially over the length of said tube.

3. The safety device of claim 2, wherein said wire is a bismuth, aluminum, tin, lead, cadmium, thallium, or zinc wire, or a combination of 2 or more of these.

4. The safety device of claim 3, wherein said wire is an aluminum wire.

5. The safety device of claim 1, wherein said insulator is both a heat insulator and an electrical insulator.

6. The safety device of claim 1, wherein said insulator is a sleeve that encloses the wire which is both a heat insulator and an electrical insulator.

7. The safety device of claim 1, wherein said insulator is made from fiber glass, ceramic fibers, asbestos fibers, polyester fibers, mica paper, phlogopite, muscovite or a composition including any of these, or a combination of 2 or more of these.

8. The safety device of claim 6, wherein said sleeve is a knitted, woven, or braided tube.

9. The safety device of claim 1, wherein said insulator prevents contact between said reflector and said low melt wire.

10. The safety device of claim 1, wherein said tension device includes a spring, a hanging weight, a spring bow, or a spring clip.

11. The safety device of claim 10, wherein said tension device is a spring.

12. The safety device of claim 6, wherein said wire is an aluminum wire, said sleeve is a braided fiberglass sleeve, said tension device is a biased spring.

13. The safety device of claim 11, wherein said spring is held in tension by an attachment that is fixed to the reflector.

14. The safety device of claim 13, wherein said attachment is a clip secured on the reflector.

15. The safety device of claim 1, whereupon if the low melt wire is discontinuous it will break a circuit directly or indirectly to effect the disablement of the heater.

16. The safety device of claim 15, where the circuit broken could be any one of, or a combination of the blower, pressure switch, gas valve, thermostat, main power supply or ignition control to effect the disablement of the heater.

17. A method for safely operating a positive pressure radiant tube heater incorporating a device intended to disable the heater in the event that there is a failure of the heat exchanger, comprising providing a low melt wire loop in the electrical circuit, insulating said wire from any grounded components of the heater and positioning said wire above the reflector of said heat exchanger wherein said position of said wire includes placing the wire under tension so that upon melting, the remaining wire pulls any unmelted wire further apart, to prevent any resolidifying of said wire upon cooling, and thereby preventing the completion of said electrical circuit.

18. The method of claim 17, wherein said wire is a bismuth, aluminum, tin, lead, cadmium, thallium, or zinc wire, a composition based on any of these, or a combination of 2 or more of these.

19. The method of claim 17, wherein said insulator is both a heat insulator and an electrical insulator.

20. The method of claim 17, wherein said placing the wire under tension is accomplished by using a tension device including a spring, a hanging weight, a spring bow, or a spring clip.

21. A radiant heater having a positive pressure radiant heat exchanger; a blower for blowing air into said heat exchanger, a gas flow control device for supplying or terminating gas to said heat exchanger, an ignition device for igniting the gas when the gas control supplies gas to said heat exchanger, a reflector positioned above said heat exchanger, the improvement comprising: a low melt wire, an insulating sleeve positioned about said low melt wire, said wire and sleeve positioned on top of said reflector, a tension device to maintain said wire under tension, whereupon the heater will be disabled if the wire is discontinuous.

22. A safety device for disabling a positive pressure radiant tube heater upon failure of the heat exchanger, comprising a radiant tube heat exchanger, a reflector positioned above said heat exchanger, a low melt wire, a tension device to maintain said wire under tension and insulatively spaced from and above said reflector, whereupon the heater will be disabled if the wire is discontinuous.

* * * * *